United States Patent [19]

Pignal et al.

[11] Patent Number: 4,593,479

[45] Date of Patent: Jun. 10, 1986

[54] AUTOMATIC MACHINE WITH MULTIPLE STATIONS FOR DRYING TEXTILE PACKAGES

[76] Inventors: Maurice Pignal, 13 Petit Chemin de la Muette, 07200 Annonay; Max Tridon, 67 Rue Bataille, 69008 Lyon; Michel Martin, 58 rue Victor Hugo, 69002 Lyon, all of France

[21] Appl. No.: 632,932

[22] Filed: Jul. 20, 1984

[51] Int. Cl.[4] ..... F26B 11/08

[52] U.S. Cl. ..... 34/58; 34/105; 34/236

[58] Field of Search ..... 34/58, 104, 105, 236; 198/339, 432; 414/131, 908, 910, 911

[56] References Cited

U.S. PATENT DOCUMENTS

| | | | |
|---|---|---|---|
| 1,973,953 | 9/1934 | Gordon | 34/58 |
| 2,294,274 | 8/1942 | Buxbaum | 414/131 |
| 2,452,638 | 11/1948 | Drum et al. | 34/58 |
| 4,090,309 | 5/1978 | Rollins | 34/58 |
| 4,457,665 | 7/1984 | Fluck | 414/131 |
| 4,464,846 | 8/1984 | Itoh et al. | 34/58 |

*Primary Examiner*—Albert J. Makay
*Assistant Examiner*—David W. Westphal
*Attorney, Agent, or Firm*—Dowell & Dowell

[57] ABSTRACT

The turntable 1 bears eight rods 3 on which are mounted stacks of packages 4, which are brought on slides 20. The latter recoil each time to allow the stack to drop onto the table 19, then advance to push the lower package 14 towards a drying station where a jack 25 descends thereon and applies it on the rotating plate of an individual drying machine. This plate lowers inside a vessel; it rotates to ensure drying; finally, it rises and the dried package is pushed by the following one onto a corridor 28 which takes it to an evacuation conveyor 27. The drying stations may be disposed in a circle and various means are provided to ensure guiding of the packages between the turntable 1 or equivalent and the various stations.

4 Claims, 28 Drawing Figures

AUTOMATIC MACHINE WITH MULTIPLE STATIONS FOR DRYING TEXTILE PACKAGES

It is known that textile yarns or filaments are frequently treated by the wet process whilst they are in the form of masses wound in packages. Thus, for dyeing thereof, in particular, such packages are often stacked on or in perforated tubes which are mounted on rods borne by hollow circular plates in which the dyeing solution is injected, so that it penetrates into each of said tubes through an opening provided to this end. Said tubes being closed at the top, it must pass through the packages and thus regularly impregnate the yarns which constitute them.

When such a treatment is terminated, it is important to dry each mass in order to expel therefrom the liquid that it has retained. To this end, small individual centrifuges are used, each receiving a single package. It will be understood that this modus operandi poses difficult problems of handling as each package represents only a relatively small mass of yarn.

The invention aims at making it possible to produce a machine due to which the necessary handlings can be rendered automatic, at least for a very large part, and which consequently enables a high production with relatively little man-power to be obtained.

In accordance with the invention, this machine comprises means for disengaging the successive stacks from the plate which bears them, a row of individual stations to which these stacks are taken, each station comprising a receiving table, a centrifuge, means for successively pushing the packages of the stack into the basket of the centrifuge, means for extracting from this basket each dried package before introducing the following one, and means for evacuating the dried packages leaving the said basket.

The accompanying drawing, given by way of example, will enable the invention, the characteristics that it presents and the advantages that it is capable of procuring, to be more readily understood.

Figure 3:
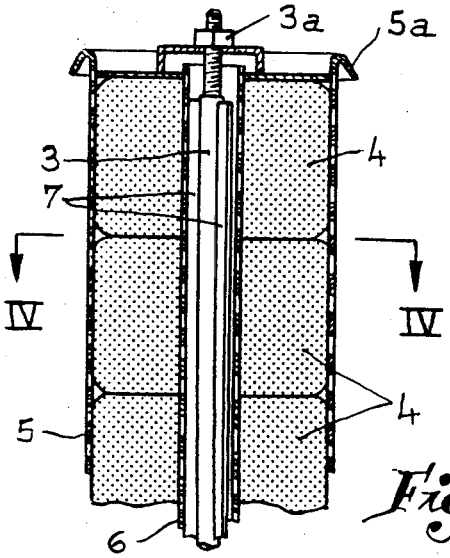
FIG. 3 is a partial section of a first type of stack of packages.
Figure 7:
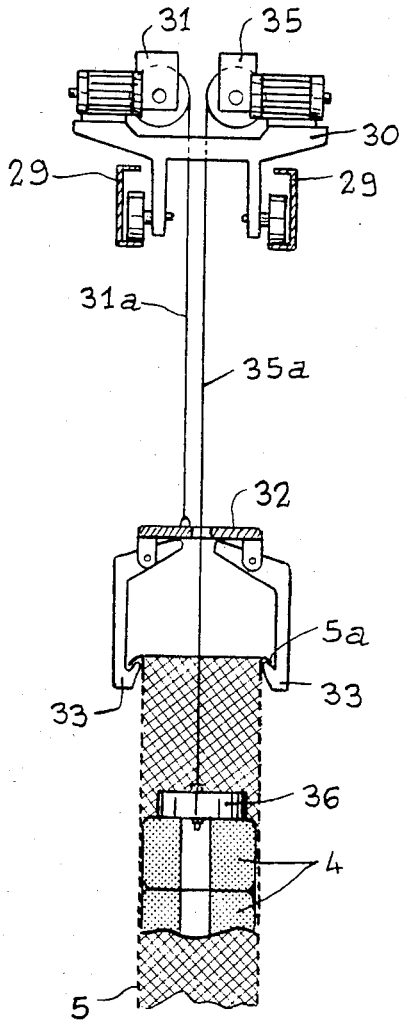

FIG. 7 indicates in somewhat schematic form the assembly of a stack according to FIG. 3 supported above such a station by a corresponding carriage of the upper conveyor.

Figure 6:
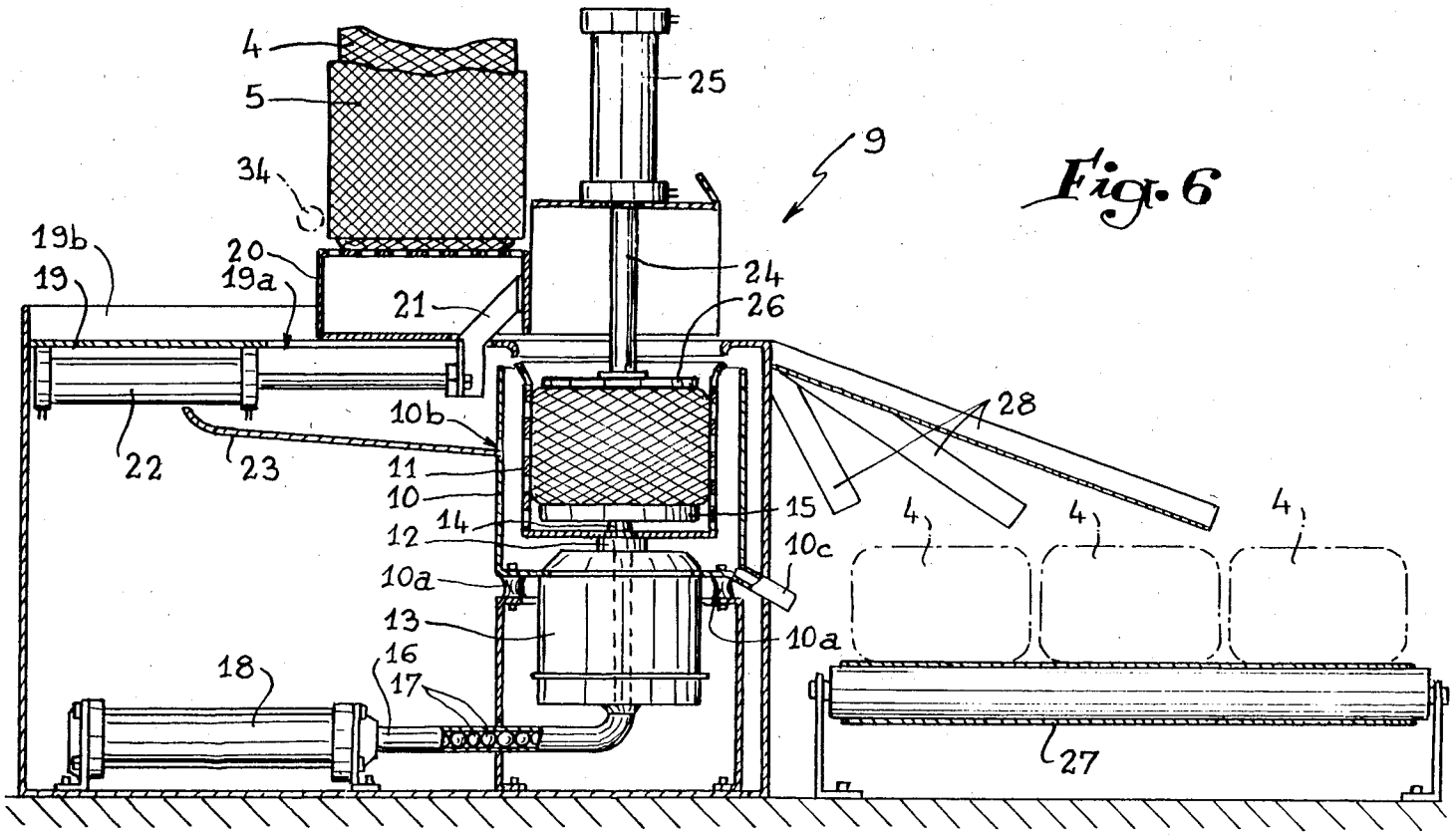
FIG. 6 is a side view of one of the stations of the machine of FIG. 1.

FIGS. 8 to 14 are diagrams showing the operation of the station of FIG. 6.

Figure 5:
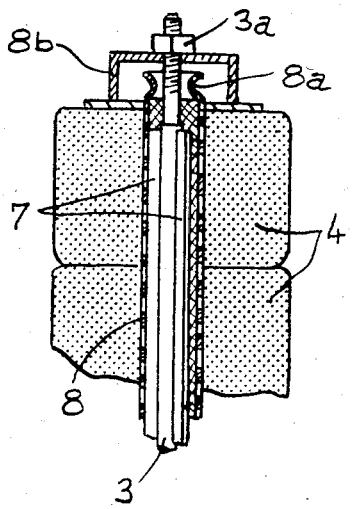
FIG. 5 is a section similar to that of FIG. 3, but corresponding to another type of stack.
Figure 15:
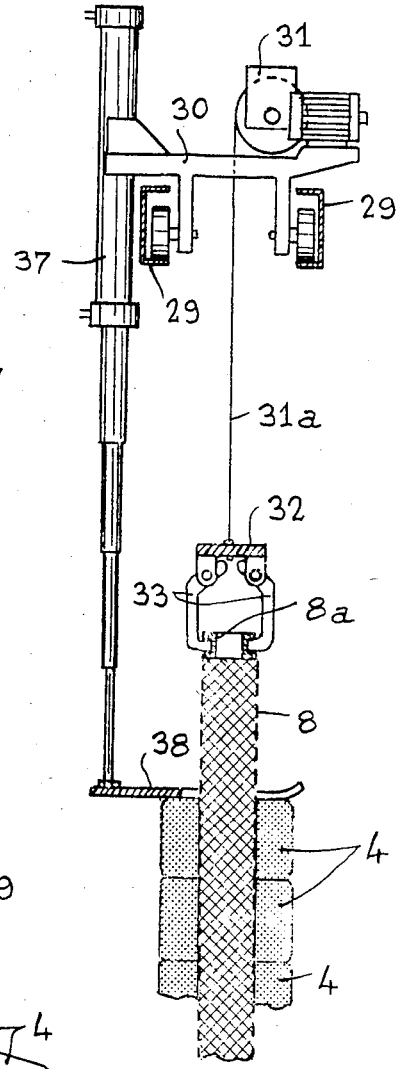

FIG. 15 is a view similar to that of FIG. 7, but corresponding to a stack according to FIG. 5.

Figure 1:
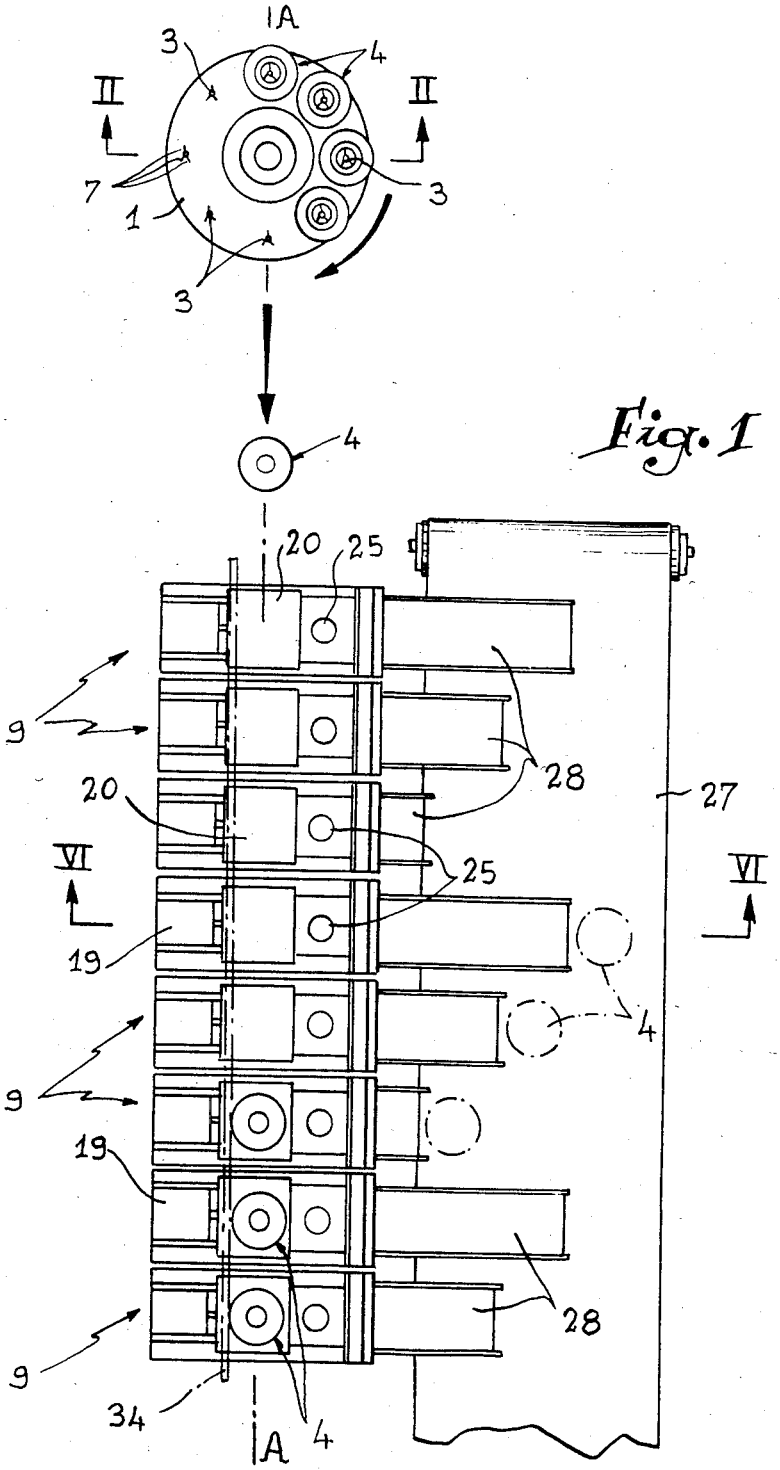
FIG. 1 is a plan view of a first embodiment of a machine according to the invention, the upper conveyor not being shown.
Figure 16:
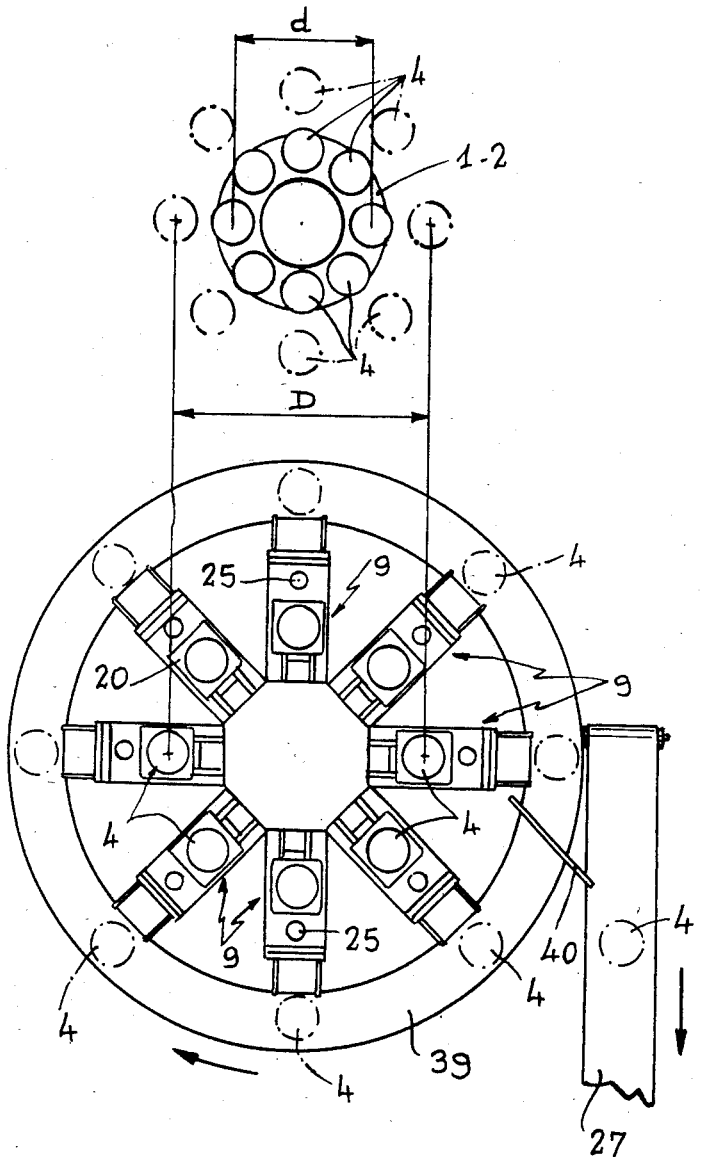

FIG. 16 is a plan view similar to that of FIG. 1, but corresponding to a machine in which the stations are disposed in a circular row.

Figure 17:
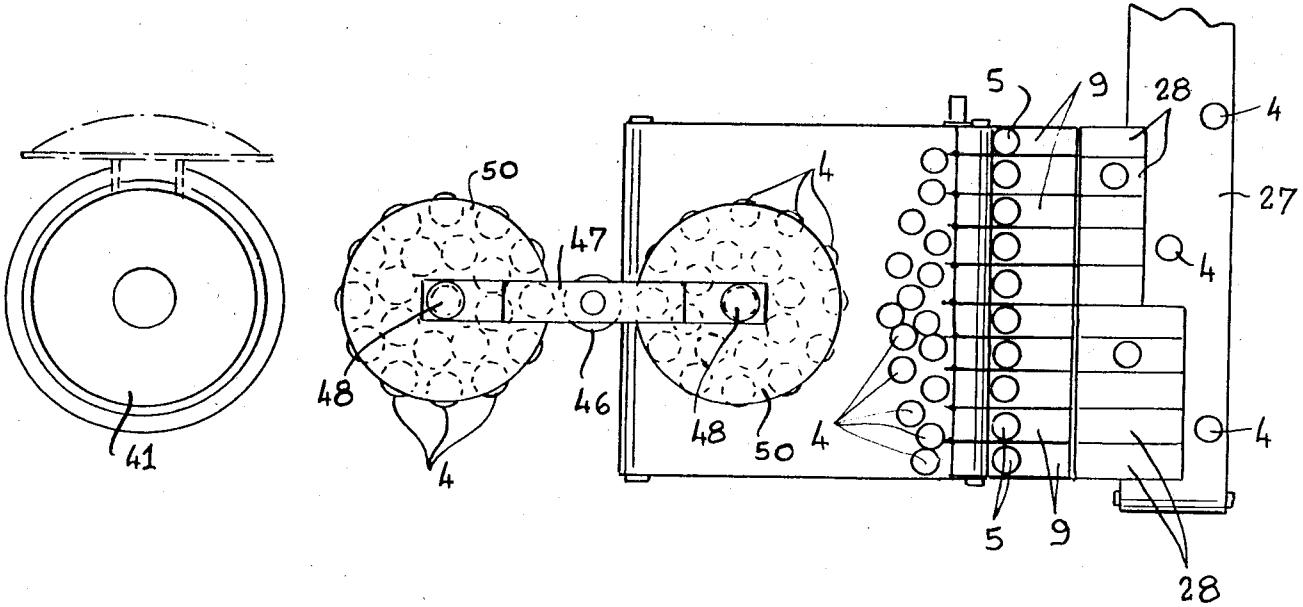

FIG. 17 shows in plan another embodiment of a machine according to the invention with intermediate distributor adapted to supply all the drying stations somewhat simultaneously.

Figure 18:
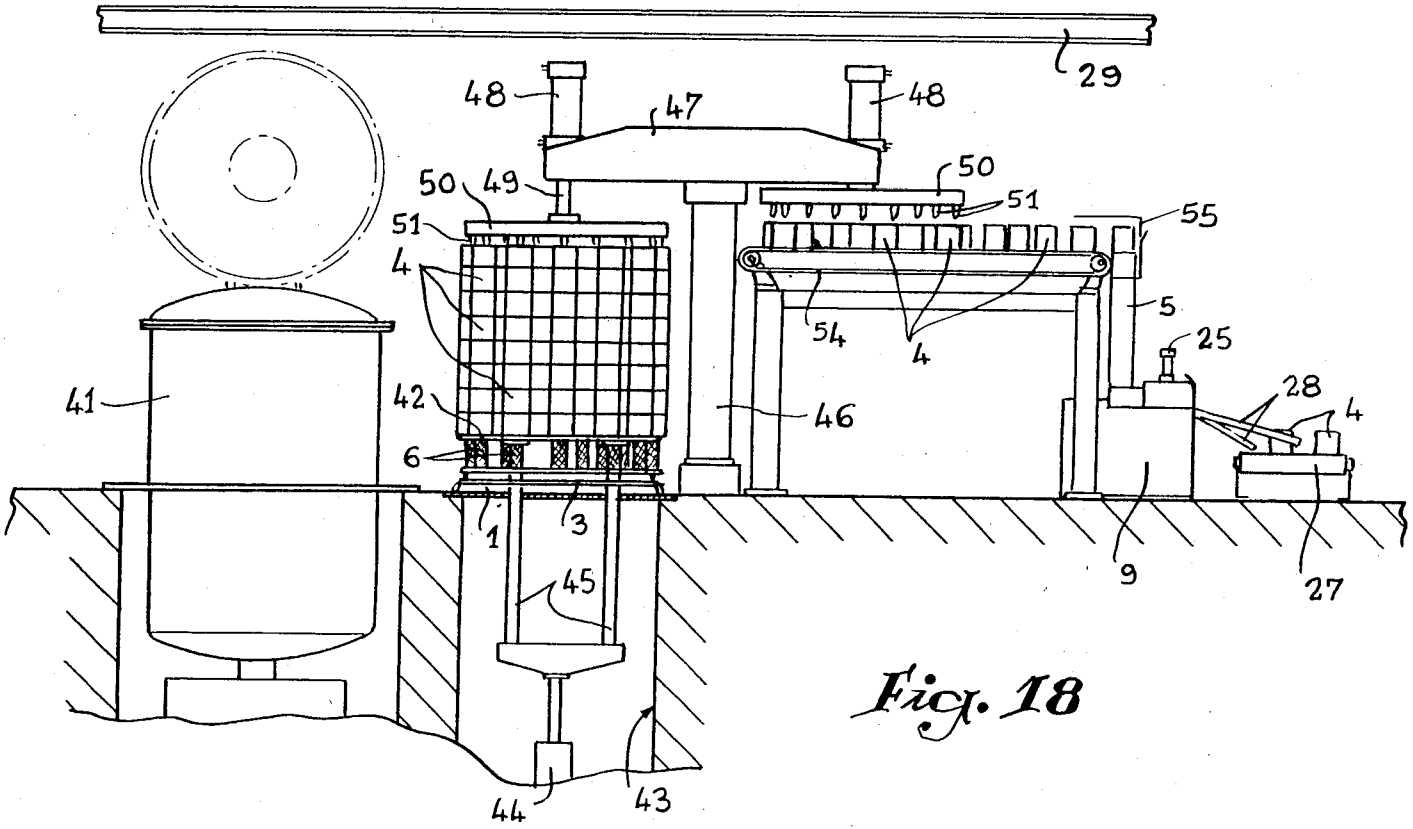

FIG. 18 is the corresponding view in elevation.

Figure 19:
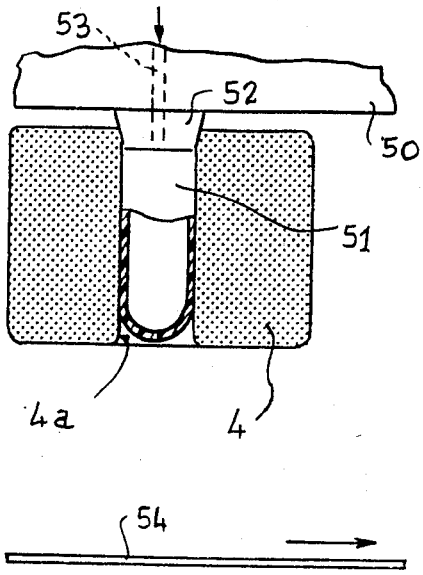
Figure 20:
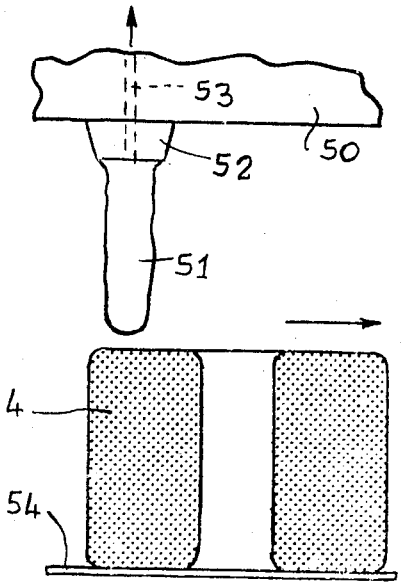

FIGS. 19 and 20 are sections in detail showing one of the inflatable finger devices adapted to ensure grip of the packages.

Figure 21:
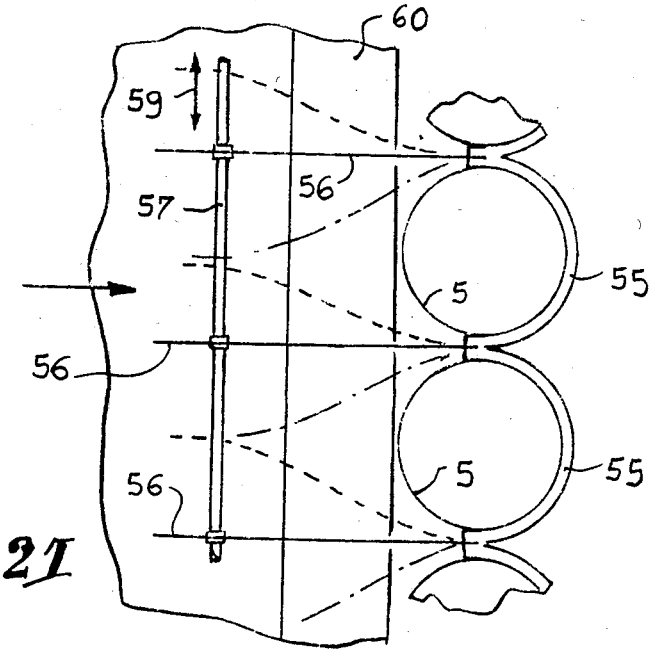

FIG. 21 is a detailed diagram in plan view on a larger scale illustrating the operation of the distributor with reciprocating movement disposed upstream of the centrifuges.

Figure 22:
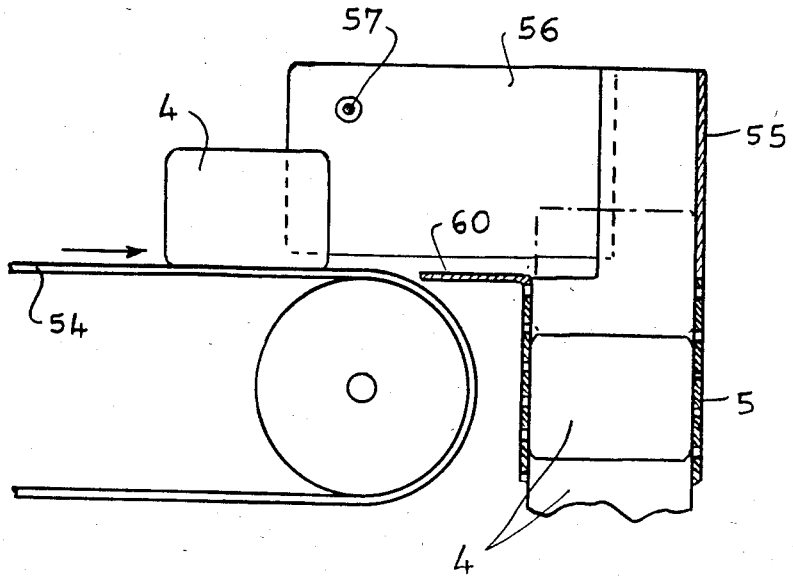

FIG. 22 is a vertical section corresponding to FIG. 21.

FIGS. 23 to 28 schematically indicate the operation of the intermediate distributor.

Figure 2:
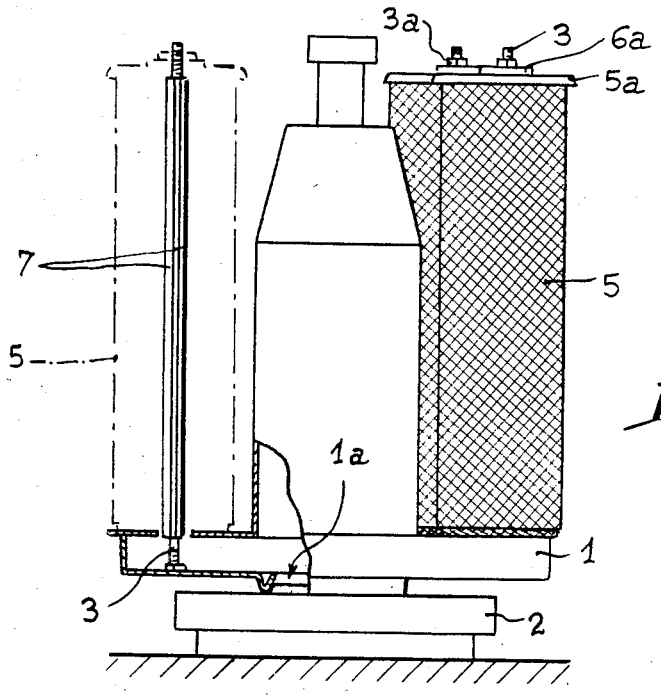
FIG. 2 is a side view with section along II—II (FIG. 1) showing on a larger scale the turntable constituted by the support plate laden with stacks of packages and the rotating base which bears this assembly.
Figure 4:
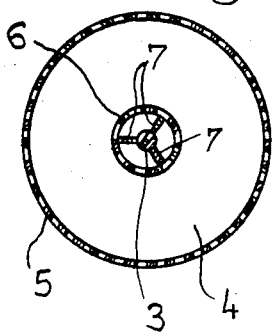
FIG. 4 is a section along IV—IV (FIG. 3).

The first element of the machine of FIG. 1 is constituted by a turntable or swivel comprising a hollow base plate 1 (cf. FIG. 2) mounted to rotate on a base 2. This plate bears eight vertical rods 3 (FIGS. 2 to 4) on each of which is fitted a stack of packages 4 maintained inside an outer perforated tube 5. To centre this stack on the rod, an inner tube 6 may be associated therewith, connected thereto by radial fins 7 and on which the said packages may slide freely. The tube 5 terminates at the top in an outer flange 5*a*.

In a variant (FIG. 5), the packages 4 may be mounted with friction on a perforated inner tube 8 which engages with free slide on fins such as 7, but which are welded only on the rod 3 in question. The tube 8 then extends in the top above the packages 4 in a part comprising a restriction 8*a*.

It will be recalled very briefly that, during the drying operation, the hollow plate 1 is mounted on a pipe which is connected at its lower central opening 1*a*. Tubes 6 or 8 being closed at the top by appropriate covers 6*a*, 8*b* retained by nuts 3*a* screwed at the end of the rods 3, the dyestuff is injected into the said pipe and is thus obliged to pass through the packages 4 radially to impregnate them. It is after this operation has been carried out that the plate 1 in question is brought onto the rotating base 2 to make the abovementioned turntable 1-2.

With this turntable 1-2 is associated a rectilinear row of drying stations 9 (FIG. 1). As shown in FIG. 6, each of them includes an elementary centrifuge comprising a fixed vat 10, a rotating basket 11 borne by a hollow shaft 12, a drive motor 13 associated with this shaft, a lower push element 14 capable of sliding axially in the shaft 12, an elevator plate 15 fixed to the upper end of this push element, a bent tube 16 containing balls 17 and which opens out in the bottom of the motor 13 along the axis thereof so that the balls 17 may act on the push element 14, and a jack 18 whose rod may slide in the horizontal part of the tube 16 to push the balls located therein and thus cause the plate 15 to rise inside the perforated basket 11.

The vat 10 and motor 13 assembly may be mounted on elastic blocks 10*a* in known manner.

To each elementary centrifuge there corresponds a table 19 whose upper face is substantially flush with the upper edge of the vat 10. On this table may slide a hollow slide 20 whose height is equal to or very slightly less than that of a package 4. This slide is fast with an arm 21 which passes through a slot 19*a* in the table to be coupled to the end of the rod of a horizontal jack 22. The arrangement is such that the slide, suitably guided by appropriate guides not detailed (and which may be constituted by the slot 19*a*), moves along a path which passes through the vertical axis of the motor 13 and of the perforated basket 11.

As shown in FIG. 1, if the row of stations 9 is considered, the corresponding slides 20 move perpendicularly thereto and the arrangement is such that, when these slides are in the recoiled position, i.e. pushed completely to the left in FIG. 6, they clearly lie this side of the vertical plane A—A (FIG. 1) passing through the axis of the turntable 1-2 and parallel to the alignment of the stations 9.

The upper wall of each slide 20 is perforated for reasons which will be better understood hereinafter, and below the recoiled position of the latter, there is provided beneath the table 19 a collecting spout 23 which opens out in the vat 10 via an orifice 10*b*. 10*c* indicates on the other hand the evacuation pipe of said vat.

Above the vat 10 is disposed an upper push element 24 coaxial thereto and controlled by a jack 25, and which bears a plate 26 at its lower end.

In front of the row of stations 9 there runs a conveyor belt 27 of relatively large width (more than three times the diameter of a package 4 in the example shown). With each station there is associated an inclined corridor 28 which, starting at the top of the corresponding vat 10, descends in the direction of this belt. As shown in FIG. 1, these corridors are arranged so as to terminate at different locations in the width of the belt 27. In the example shown, starting from the left, the first corridor 28 is relatively long, the following one shorter, the third still shorter, then the fourth resumes the length of the first, and so on, in groups of three. If reference is now made to FIG. 7, above the turntable 1-2 and the row of stations 9, and in the plane A—A mentioned above, there is disposed a conveyor 29 (with two rails in the example shown) on which a carriage 30 may move. The latter supports a first winch 31 from whose cable 31*a* is suspended a system 32 comprising two articulated jaws 33 in the form of hooks with oblique lower edge.

Operation is as follows:

Assuming firstly, to fix ideas, that the arrangement is that of FIG. 1 (packages 4 stacked in an outer tube 5), the carriage 30 is brought above one of these stacks borne by the plate 1 of the turntable, for example the one which is nearest the beginning of the row of stations 9. The first winch 31 is then actuated for descent and the jaws 33 open so as to pass on either side of the outer perforated tube 5 and return and hook below the flanges 5*a*. The packages are blocked inside the tube 5 by any means (not shown), for example with the aid of a tab provided at the lower end of said tube 5 so as to be able to pivot inwardly about a vertical axis. The winch 31 is then actuated for lift so as to raise the stack in question and disengage it from the corresponding rod 3. The carriage is then displaced over the path 29-30 so as to bring this stack just above an empty station immediately to the rear of the vat 10, the corresponding slide being in the advanced position of FIG. 6 and the elevator plate 15 being raised by the jack 18, the balls 17 and the push element 14 so as to be located at the level of the table 19, whilst the upper plate 26 is also in high position.

Figure 8:
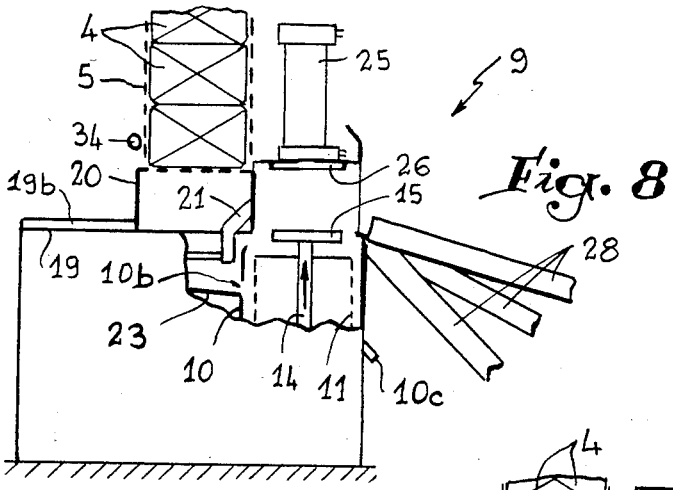

The winch 31 is then actuated for descent until the stack is deposited on the slide 20. The position indicated in FIG. 8 is thus reached.

The tab or other device for stopping the packages 4 inside the tube 5 is then disengaged, so that said packages can slide freely in the tube.

Figure 9:
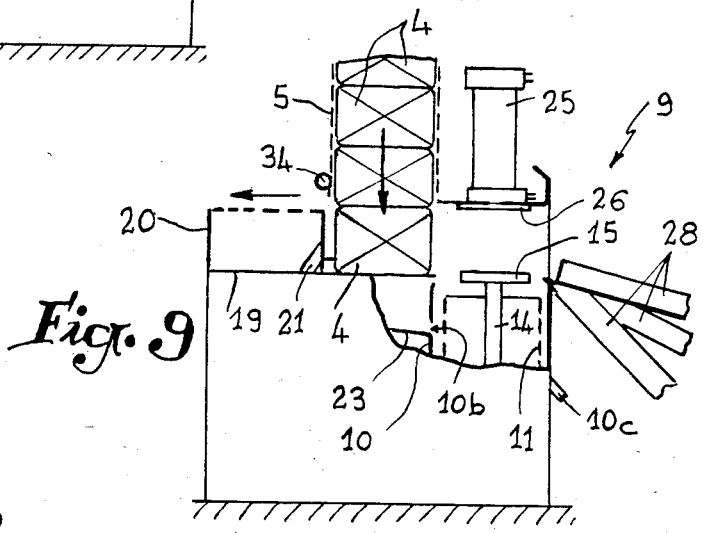
Figure 10:
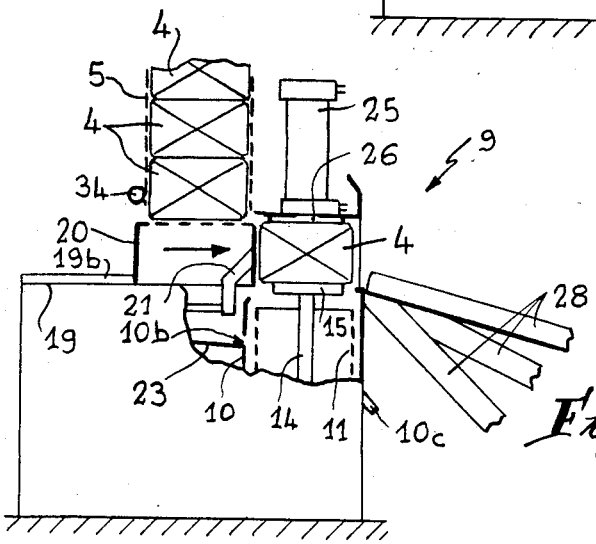

The slide 20 recoils, i.e. retracts leftwardly in FIG. 6, so as to disengage the lower opening of the perforated tube 5. Of course, to this end, the tube must not follow the movement of the slide, which may be avoided, if necessary, by providing to the rear of this tube a bar such as the one shown in broken lines at 34 (FIGS. 6 and 8) extending over the whole row of stations. In any case, due to this recoil, the lower package 4 of the stack drops onto the table 19, since it has been assumed that it could slide freely in said tube. The position shown in FIG. 9 is thus reached. As to the tube, it is retained in the vertical direction by appropriate means (not shown) particularly by the winch itself remaining in position above the station in question.

This done, the slide 20 advances. It causes the lower package 4, now disengaged from the tube 5, to slide on the table 19 and it thus brings it on the elevator plate 15 (position of FIG. 10). The other packages remain maintained by the upper wall of the slide.

Lateral guides such as 19*b* (FIG. 6) may possibly be provided on the table 19 so that the package 4, pushed by the slide 20, cannot deviate laterally.

Figure 11:
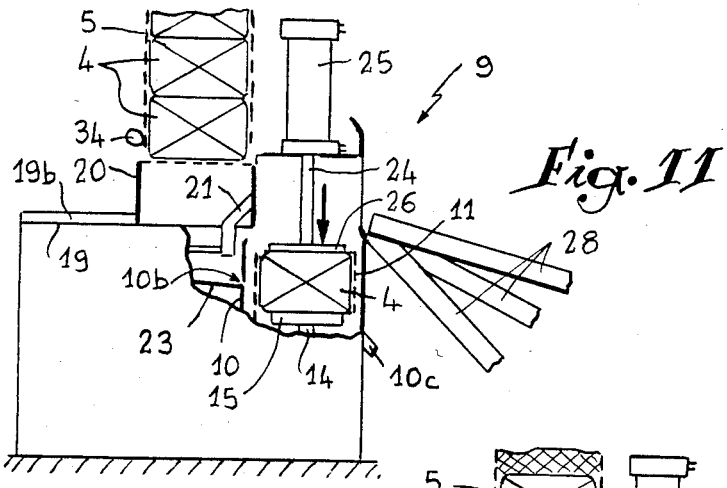

The plate 15 then lowers so that the package 4 in question engages in the rotating basket 11 to be subjected therein to the action of the centrifugal force. At the same time, the upper plate 26 is lowered by its jack 25 so as to prevent the package from being crushed on rising on the wall of the basket. The position of FIG. 11 is thus reached.

Figure 12:
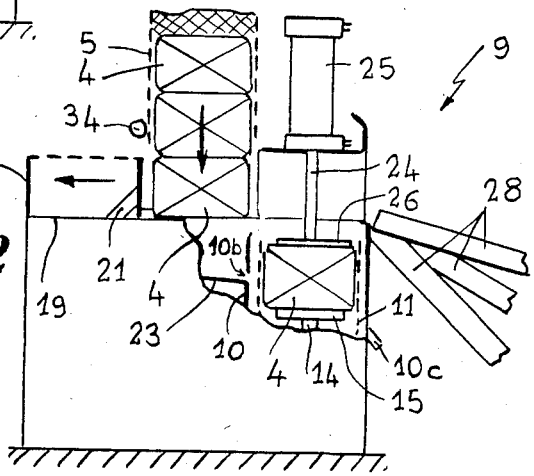

During centrifugation, the slide 20 recoils so that the following package 4 of the stack drops on the table 19, as indicated in FIG. 12.

Of course, the plates 15 and 26 are arranged so as to be able to rotate freely with the basket 11. Thus, for example, the upper plate 26 may be mounted on an appropriate ball bearing.

Figure 13:
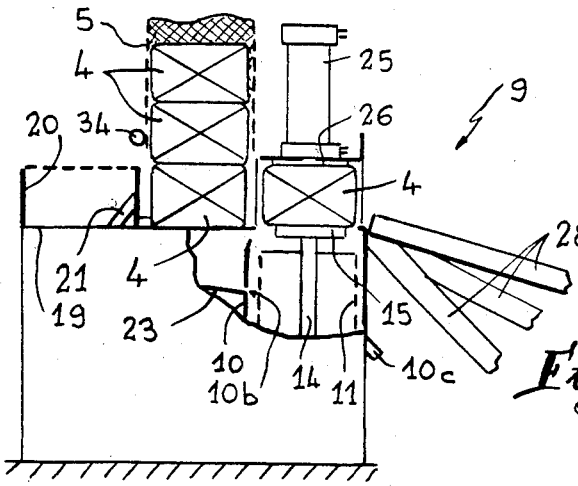

Once drying is terminated, the plates 15 and 26 rise to return the treated package 4 to the level of table 19 (position of FIG. 13).

Figure 14:
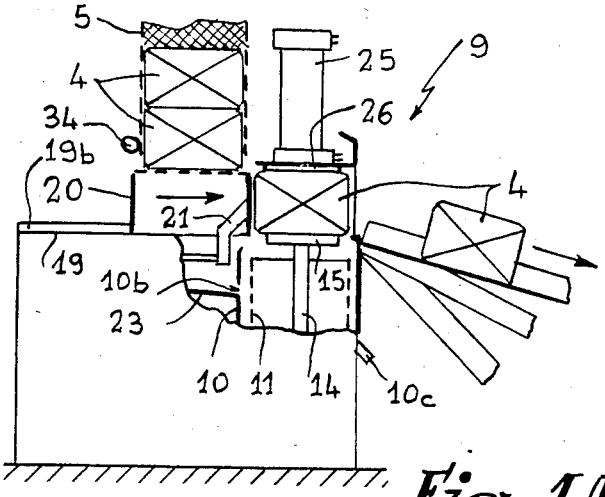

The cycle which has just been described is then repeated. However, this time, during advance of the slide 20, the fresh package 4 driven by the latter pushes the package 4 having left the vat 10 and thus takes it onto the corresponding corridor 28 on which it slides to arrive on the belt 27 which takes it towards an appropriate receiving station (not shown), as shown in FIG. 14.

It will be understood that all the packages of the stack may thus be dried one after the other. When this is done, the carriage 30 may be returned above the turntable 1-2, which has meanwhile advanced by one step to present a fresh stack to the jaws 33 of the carriage.

During all the individual operations described, the stack of packages 4, which is very wet, drains off to a considerable extent. It is for this reason that the slide 20 is provided with a perforated horizontal wall and that the collecting spout 23 is disposed beneath the table 19 which may also be made with perforated wall if its slot 19*a* is not sufficient to ensure flow of the water.

In practice, a number of carriages 30 equal to that of the stations is provided and there is arranged for the upper conveyor 29 a return path towards the starting position. All the stations of the installation may then be arranged to operate at the same time. In a variant, switches or the like might moreover be provided, in order that, when the stacks are in useful position above the stations, the path remains free to make it possible to evacuate any carriage whose stack is exhausted and to replace it by another bearing a complete stack, all without having to stop the other stations.

Furthermore, it will be understood that, thanks to the division of the width of the conveyor belt 27 into three, the treated packages are evacuated regularly without risk of knocking one another. It is moreover possible to programme the whole of the machine to avoid any collision and effect a strictly continuous operation.

It may happen that the packages 4 are tightened inside the tube 5 and that they cannot slide freely therein under the sole effect of their weight in the wet state. To overcome this, a second winch 35 may be provided on the carriage 30 (FIG. 7) whose cable 35*a* bears at its end a weight 36 which is made to rest on the stack.

In the foregoing explanations, it has been assumed that the stacks were of the type illustrated in FIG. 1, i.e. composed of packages 4 mounted inside a common tube 5. However, it will readily be understood that they are also applicable, mutatis mutandis, for stacks of the type of FIG. 5, in which the packages are disposed on a common inner tube 8. Being given that the forces of friction between the tube and the successive packages are then relatively strong, an auxiliary jack 37 may, as shown in FIG. 15, be associated with the carriage 30, said jack disposed on the side with respect to the jaws 33 (obviously provided here to be more tightened than in the preceding case so as to cooperate with the restriction 8*a*), this auxiliary jack bearing at its end a finger 38 in the form of a fork which acts on the upper package of the stack to slide the whole of the latter on the tube 8 downwardly each time a fresh package is to be deposited on the table 19 at the station in question.

In the example shown, the jack 37 has been shown as being telescopic in form with a view to reducing its dimensions in height.

FIG. 16 schematically indicates a variant in which the stations 9 are no longer disposed along a rectilinear row as in FIG. 1, but in a circle. In this embodiment, there is suspended from the carriage 30 of FIG. 7 a mobile assembly of eight channels disposed as a star and on which roll eight secondary carriages. At the outset, the star-shaped assembly lies above the turntable 1-2, the eight secondary carriages are tightened towards the centre (diameter d of the stacks) so that the main carriage being centred above the turntable, the winches associated with said secondary carriages may raise and disengage the eight stacks. They then move away from one another (diameter D) so that these stacks are disposed in a star identical to that made by the locations that they must occupy once positioned on the tables 19 of the stations 9. The main carriage then moves to be centred on the star thus constituted by the stations 9. It is easy to understand that if the diametrical spacing D of the secondary carriages in spaced apart position has been suitably chosen, the eight stacks may be directly lowered on the table 19 for their packages to be able to be successively brought to the baskets of the centrifuges. In such a machine, the stations being oriented in the centrifugal direction (the centrifuges towards the outside of the circle), the dried packages are pushed on a sort of rotating carrousel 39 constituted by a suitably driven annular conveyor belt and they are deviated upon passage towards the evacuation belt 27 by a fixed deflector 40.

It will be understood that operation otherwise remains the same as that described hereinabove with reference to FIGS. 8 to 14.

In the embodiment of FIGS. 17 to 27, the evacuation conveyor belt 27 is found again with the corridors 28 which bring thereto the dried packages 4 coming from the rows of centrifugation units 9.

An autoclave has been indicated at 41 (FIGS. 17 and 18) in which the packages 4 are treated with a view to dyeing thereof or other operation. The latter are mounted on perforated tubes 6 fast with a base plate 1 (which has been assumed to be already withdrawn from the autoclave in FIGS. 17 and 19). In the example shown, this plate bears twenty one tubes distributed along two concentric circular rows, plus one at the centre of the plate.

In addition, on the base plate 1, there is provided an intermediate plate 42, suitably peforated to allow passage of the tubes 6 (and possibly that of the draining water), this plate thus being interposed between the packages 4 and the base plate 1.

There is further provided an upper conveyor with one or two rails 29 (FIG. 18) with which is associated a carriage with block and pulley (not shown) adapted to make it possible to extract from the autoclave 41 the assembly of the base plate 1, the intermediate plate 42, the tubes 6 and the packages 4 to be dried, to bring it above a pit 43 (FIG. 18) which contains a jack 44 adapted to raise two rods 45 which, passing through the base plate 1 through appropriate perforations, act on the intermediate plate 42 to raise it with the packages 4 which then slide on the perforated tubes 6.

On the side of the pit 43 opposite the autoclave 41 there is disposed a distributor system or robot. The latter comprises a column 46 which rotatably bears a head 47 in the form of a crosspiece. At each of its ends, this head is equipped with a vertical jack 48 of which the rod 49, oriented downwardly, supports a plate 50, which, for a determined angular position of said head 47, lies above the pit 43, coaxially to the jack 44. The lower face of this latter is equipped with inflatable vertical fingers 51, made of rubber or the like, shown in detail in FIGS. 19 and 20. As shown, each of them is in the form of a sleeve of which the lower end is closed, whilst the upper end joins a truncated base 52. A duct 53 provided in the plate 50 makes it possible to connect all the fingers 51 thereof to the same control duct (not shown) which may be connected to a source of compressed air for inflating the fingers, or on the contrary to the atmosphere to deflate them.

In the deflated state (FIG. 20), the fingers 51 have a diameter less than that of the cylindrical inner space 4*a* of the packages 4. They may therefore be freely engaged therein. If they are then inflated, they bear against the inner wall of the packages 4, thus being fixed thereto, as clearly shown in FIG. 19.

Below the head 47 and on the other side of the column 46 with respect to the pit 43, is disposed the upstream end of a conveyor belt 54 intended to bring to the centrifugation units 9 the packages 4 which the head 47 deposits thereon in the manner which will be set forth hereinafter. At the downstream end of this belt 54, there is provided a distributor of which FIGS. 21 and 22 show details. It essentially comprises a stop screen 55 made of a succession of semi-circular parts opening in the direction of the head 47 and comprising a radius a little greater than that of the packages 4. This screen extends downwardly by the perforated tubes 5 associated with the centrifugation units (cf. FIG. 6), but which are here permanently fixed in place, and no longer displaceable. At the edges of the screen 55 are fixed elastic blades 56, of height greater than that of a package 4 and which extend longitudinally above the belt 54. These blades are traversed near their free edge and in their upper part by a common rod 57 which connects them to a transverse lateral jack 58, which is controlled so as to cause them to oscillate as indicated by arrow 59 with an amplitude substantially equal to the radius of the tube 5 in one direction and in the other. As shown in FIG. 22, the belt 54 stops immediately upstream of the tubes 5, which are fast with a sort of shelf 60 which extends up to the immediate vicinity of the belt.

Operation is as follows:

Assuming that an assembly of packages 4 borne by a base plate 1 has been treated in the autoclave 41, the latter is opened and, with the aid of an appropriate block and pulley and an upper conveyor to which the rail or rails 29 correspond, the plate with the base in question is raised and taken above the pit 43 where it is centred by appropriate means (marks, stops) both in axial position and in angular position.

Figure 23:
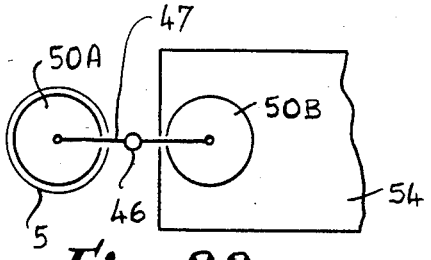

For the following explanations, reference will be made to the diagrams of FIGS. 23 to 28 in which the two plates 50 of FIGS. 17 and 18 have been respectively referenced 50A and 50B to distinguish them. The plate 50A is firstly brought exactly above the package 4 assembly, as shown in FIG. 23. The jack 44 is manoeuvred so as to raise the intermediate plate 42 by the height of a package. The said plate is lowered so that its fingers 51, then not inflated, penetrate inside the packages of the upper layer. Of course, this requires a perfect centering, but one which any technician can effect, possibly automatically with the aid of a programmer or the like.

Once the fingers 51 are thus introduced into the packages 4, they are inflated, then the plate 50A is raised, taking with it the said packages.

Figure 24:
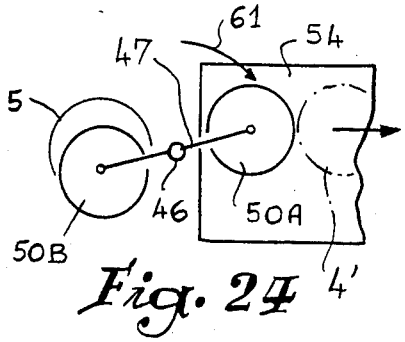

The head 47 is then rotated through a little less than a half-turn in the direction of arrow 61 (FIG. 24) so as to bring the plate 50A, thus laden with packages, above the conveyor 54, but in a position slightly offset on the side (upwardly in FIG. 24). The fingers 51 of this plate are deflated so that the packages drop onto the conveyor which takes them towards the right, as indicated at 4'.

Figure 25:
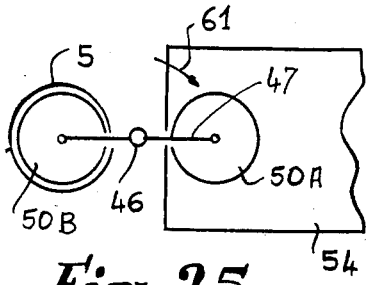

The head 47 is then rotated through a small angle so as to bring plate 50B above the package 4 assembly, as shown in FIG. 25. The intermediate plate 42 is again raised by the height of a package, the plate 50B is lowered so that its fingers 51 engage in the non-inflated state in the packages of the second upper layer, the fingers are inflated and the plate is raised, taking with it the packages of this layer.

Figure 26:
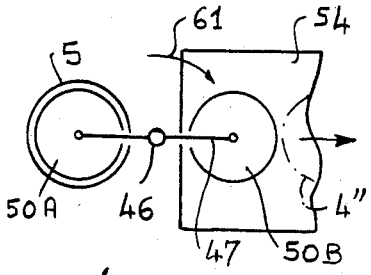

The head 47 is then rotated through a complete half-turn so that head 50B laden with packages 4 lies above the conveyor 54 and in the axis thereof, as indicated in FIG. 26. The fingers are deflated and the packages of the second layer mentioned above drop and are driven as indicated at 4''.

During this time, the intermediate plate 42 has been raised by the height of a package, the plate 50A has been lowered to engage its fingers 51 inside the packages of the third upper layer and they have been inflated.

Figure 27:
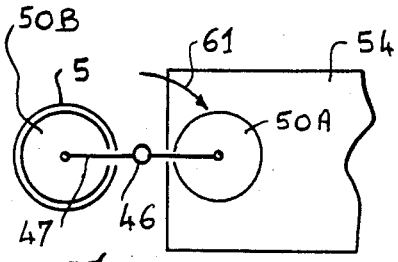
Figure 28:
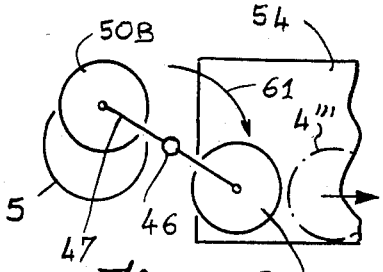

This plate 50A is raised, FIG. 27, taking along the packages of this third layer and the head 46 is rotated by more than a half-turn (arrow 61), so as to bring the plate 50A above the conveyor 54, but in a laterally offset position (downwardly in FIG. 28). The fingers of this plate 50A are deflated and the layer of packages which it bears (third upper layer 4''') is evacuated by the conveyor to the right in FIG. 28.

The cycle which has just been described is then recommenced as many times as is necessary to bring onto the conveyor 54 all the packages borne by the base plate 1.

The packages thus taken along by the conveyor 54 during each of the operational phases described above arrive at the distributor constituted by the blades 56 with reciprocating movement. They are thus distributed over the whole width of the belt and may arrive at the screen 55 to drop into the tubes 5.

Otherwise, operation of this second embodiment is identical to that of the first described hereinabove.

Of course, the fingers 51 borne by each of the plates may be of any number. A machine might even possibly be designed in which each plate has only one finger. Furthermore, operation would be possible with only one plate 50, as may be readily imagined.

It will be noted that, in one and the other embodiment, the centrifugation units are easily dismountable, which makes it possible to provide them with baskets 11 of different shape, diameter and height.

It will be noted more particularly that the machine which has just been described may be adapted to packages of truncated form. It suffices that the centrifugation baskets 11 be shaped correspondingly, the packages to be treated being loaded with the small diameter downwards.

Of course, the baskets may be driven by any appropriate means (belt, individual motor, etc . . . ).

It will further be appreciated that the whole of the machine may be rendered automatic by using an appropriate programmer.

It will be understood in particular that the winches such as 31 and 35 may be replaced everywhere by jacks, conveyors different from those indicated may be used, it may be provided to make the stations operate in succession, the stacks being brought thereto individually; the jacks 18 may be disposed vertically under the baskets 11 and the motors 13; these latter may be replaced by an endless belt system with single motor; etc . . .

We claim:

1. A machine having multiple centrifuge units for receiving and drying individual wet packages of yarn coming from a dyeing operation, the machine comprising at each centrifugal unit:

(a) a wet package supporting table;

(b) a fixed centrifuge vat extending below the table and having an open upper end terminating adjacent to the table;

(c) a rotatable centrifuge basket in the vat and shaped to receive a yarn package and maintain its shape during centrifuging;

(d) a motor located below the basket and having a hollow shaft axially supporting the basket for rotation by the motor;

(e) an elevator plate located within the basket to support a package during centrifuging, the plate being supported by a push element extending axially downwardly therefrom into the hollow motor shaft;

(f) push means below the motor and operative in the hollow shaft to contact the push element to raise the elevator plate to the level of the table when centrifuging of a package is completed and to lower the elevator plate into the basket when supporting a wet package to be centrifuged; and (g) slide means on the supporting table and operative to push a wet package onto the elevator plate when raised, and thereby displace a centrifuged package therefrom.

2. A yarn package drying machine as claimed in claim 1, wherein said push means comprises a first jack located below the motor; a tube extending from the first jack to said hollow shaft; and multiple balls filling the tube from the first jack to the push element, whereby reciprocation of the first jack raises and lowers the elevator plate.

3. A yarn package drying machine as claimed in claim 2, wherein said first is disposed horizontally and offset from the motor, and the tube is bent at right angles between the first jack and the hollow shaft.

4. A yarn package drying machine as claimed in claim 1, wherein the machine further comprises at each centrifuge unit a second jack axially disposed above the basket and elevator plate and having a clamping plate supported by the second jack for vertical reciprocation, the second jack being operative during centrifuging of a package to lower the clamping plate against the package to maintain its shape, and being operative when the elevator plate is raised to retract the clamping plate upwardly out of contact with the package.

* * * * *